US007418769B2

(12) United States Patent
Zhang

(10) Patent No.: US 7,418,769 B2
(45) Date of Patent: Sep. 2, 2008

(54) DOWN BRANCH FIBER FABRIC AND THE FABRICATING METHOD THEREOF

(75) Inventor: Liwen Zhang, Guangzhou (CN)

(73) Assignee: Foshan Shengu Textile Company, Ltd., North Jiao, Fishan, Guangdong (CN)

( * ) Notice: Subject to any disclaimer, the term of this patent is extended or adjusted under 35 U.S.C. 154(b) by 237 days.

(21) Appl. No.: 10/542,832

(22) PCT Filed: Nov. 17, 2003

(86) PCT No.: PCT/CN03/00975

§ 371 (c)(1),
(2), (4) Date: Jul. 20, 2005

(87) PCT Pub. No.: WO2004/065675

PCT Pub. Date: Aug. 5, 2004

(65) Prior Publication Data

US 2006/0143871 A1 Jul. 6, 2006

(30) Foreign Application Priority Data

Jan. 24, 2003 (CN) ..... 03 1 03065

(51) Int. Cl.
*D01G 25/00* (2006.01)

(52) U.S. Cl. ..... 19/296; 19/48 R

(58) Field of Classification Search ..... 19/48 R, 19/105, 296

See application file for complete search history.

(56) References Cited

U.S. PATENT DOCUMENTS

| | | | | |
|---|---|---|---|---|
| 5,873,150 | A * | 2/1999 | Gerard | 19/301 |
| 6,317,932 | B1 * | 11/2001 | Staples et al. | 19/105 |
| H2105 | H * | 6/2004 | Pinto | 19/105 |
| 2002/0004970 | A1 * | 1/2002 | Pinto | 19/105 |
| 2002/0026688 | A1 * | 3/2002 | Rubenach | 19/97.5 |
| 2002/0116792 | A1 * | 8/2002 | Pinto | 19/105 |

FOREIGN PATENT DOCUMENTS

| | | |
|---|---|---|
| CN | A 1384232 | 12/2002 |

* cited by examiner

*Primary Examiner*—Shaun R Hurley
(74) *Attorney, Agent, or Firm*—Global IP Services; Tianhua Gu

(57) ABSTRACT

This invention relates to a kind of down branch fiber fabric, its fabricating method and device. The fabric is composed of 10-100% down branch fiber and 0-90% textile fiber by weight. The processing steps include material choosing, silver feeding, twisting, winding packages, heat setting and weaving. The device comprises a raw material tank, a feeding conveyer belt, a inclined feeding conveyer belt, a adjustable even roller, a brambly catching roller, a first subsiding room, an even roller, a brambly dividing roller, a second subsiding room, two dust cages. The present invention makes the down branch fiber spinnable and weavable. It solves the problem that the down branch fiber cannot be combed and drawn and drafted by the prior textile technique, so that chances the fact that the down branch fiber can only be used as the fiber stuffing to make down garments, quilts, ticks and other bedding. This new fabric is applicable to make thermal woven, hoses, quilts, ticks or other bedding.

8 Claims, 1 Drawing Sheet

DOWN BRANCH FIBER FABRIC AND THE FABRICATING METHOD THEREOF

FIELD OF THE INVENTION

Figure 1:
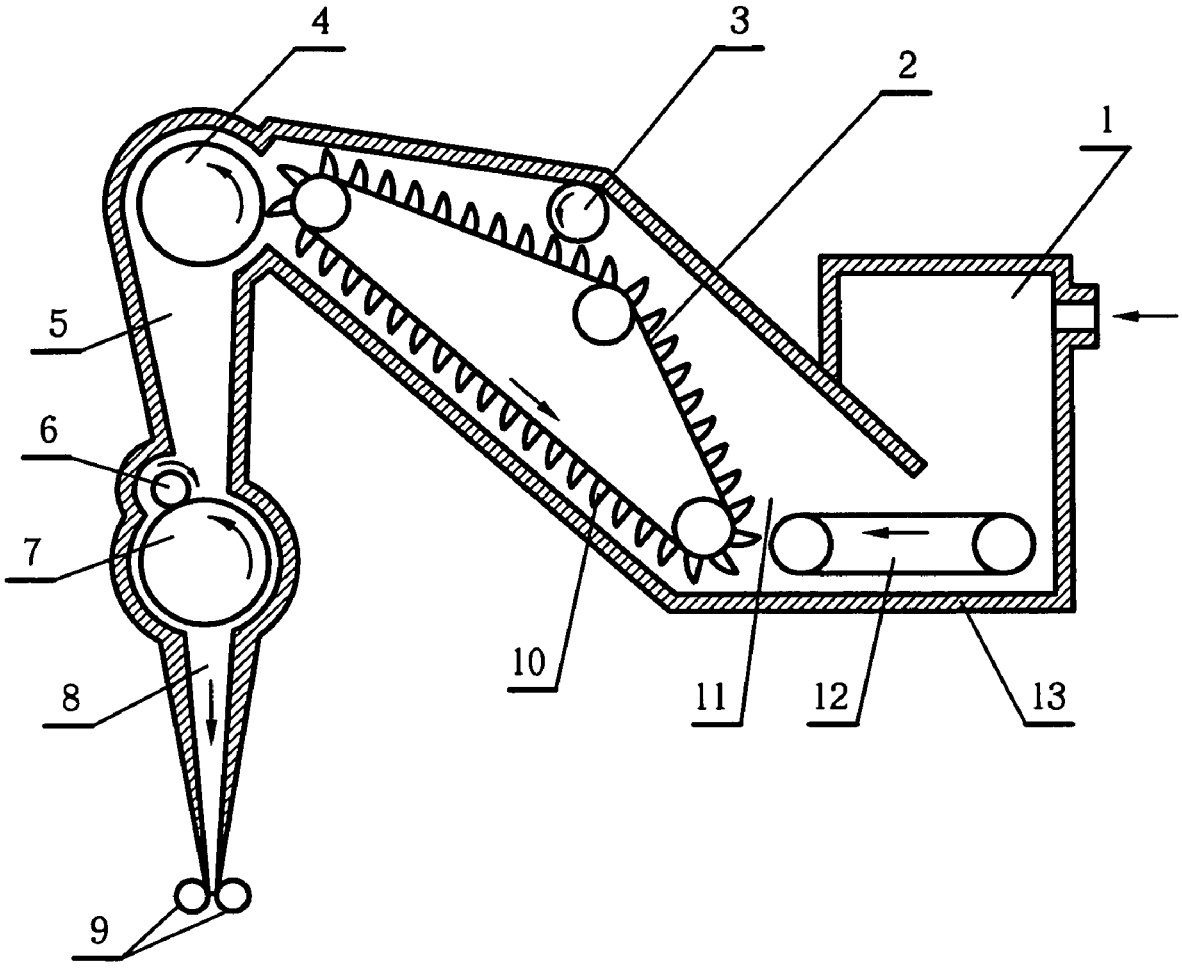

The present invention relates a kind of textile technology for down branch fiber, more particularly the present invention relates a kind of down branch fiber fabric and its fabricating method.

BACKGROUND OF THE INVENTION

Feather and down are all good natural heat-retaining materials. Feather has a flat shape with parallel barbs grown on quills in rows. Down has a shape liking cloud and down can be sorted as down-feather and semi-plume. The down feather has a fluffy structure with little shaft or no shaft. The semi-plume has a fluffy structure too, but it has well formed shaft. For these characters, the feather and down cannot be sorted as fiber. Using common technology, we can separate barb-fibers of the feather or down-branch-fibers of the down or semi-plume from their quill or shaft to get separated barb-fibers or down-branch-fibers. The barb fiber has a same structure as the down-branch-fiber but is coarser than the down-branch-fiber. The barb-fiber and down-branch-fiber both are defined as down branch fiber thereafter. Since down branch fiber has very tiny barbules and hooks distributing equally along fiber, the down branch fiber is considered as a kind of unique nature fiber with many merits, for example, soft, light, heat retaining, etc. However, to us common textile technologies such as combing, twisting, draughting to process down branch fibers is very difficult since the down branch fibers are non-crimp, fluffy, and very short, most of them are around 15 mm to 25 mm. This is the main reason that people use feather, barb-branch-fiber and down branch fiber as stuffing materials for making down garment, quilts, ticks and other bedding only.

Chinese Patent Publication Number CN1222591A titled "Down Branch Fiber Fabric and Its Fabricating Method" and Chinese Patent Publication Number CN1293270A titled "Down Shell Fabric" described a kind of spinning method for the mixture of downs or down-branch-fibers with textile fibers.

According to the common knowledge in the down products industry, down is short, soft fluff got from feathers of waterfowls, such as geese, ducks and the like. Down also means a mixture of down, feather, barb-fiber, down branch fiber and other impurity, in which the ration of down must be over the lowest standard stipulated by this industry. The "down" described in the above-mentioned two patent publications is not a kind of material having same structure, it can't be considered as fiber too. Where, the fiber means a kind of natural or synthetic thin filiform textile material only. Downs can't be used as textile materials for spin directly. If spinning the mixture of downs with other textile materials for yarns, it is impossible to get smooth and uniform yarns since down is fluffy and mixed with other impurity, such as feather and barb-fibers. During processing downs will be blown away since downs can't be mixed with other textile fibers as a uniform combination.

SUMMARY OF THE INVENTION

The purpose of the present invention is to provide a fabricating method for making fabrics from down branch fiber directly; also the purpose of the invention is to provide products made by the fabricating method, i.e. down branch fiber fabrics with strong tensile strength.

The above-mentioned objects are achieved by:

Down branch fiber fabrics are made by mixing down branch fibers with textile fibers, having a blend ration by weight of down branch fiber 10-100%, textile fiber 0-90%.

The down branch fibers are got from handling downs and feathers, which are gathered from waterfowls such as geese, ducks and the like. Cut quills and shafts off from downs, semi-plumes and feathers, then get down branch fibers.

Textile fibers are selected from at least one of nature fibers including cotton, wool, ramie fiber or synthetic fibers including terylene, acrylic, nylon, polyvinyl chloride, spandex, vinylon or chemical viscose fibers.

The method for producing down branch fiber fabrics having following processes: screening raw materials, feeding raw materials into sliver feeding device, twisting, winding packages, heat setting and weaving. The temperature for heating setting is from 80° to 120° C., heating time is from 5 to 20 minutes.

The sliver feeding devise comprises a raw material tank, a feeding belt conveyer, an adjustable even roller, a brambly catching roller, a first subsiding room, an even roller, a brambly dividing roller, a second subsiding room. All these subdevises are connected and communicated. Discharging port with a bar shape cross section is connected with dust cages coincidentally.

The present invention possesses many advantages comparing with common technologies in this field:

A. The sliver feeding devise has the brambly catching roller and the brambly dividing roller to comb the down branch fibers twice; has the adjustable even roller and the even roller to control the feeding quota of down branch fibers equably around all process; has first and second subsiding rooms to subside the raw materials twice in smooth and equal quantity to ensure that the down branch fibers can pass through the discharging port uniformly. With above-mentioned devises, the present invention solves the difficulties for processing down branch fibers, i.e. non-crimp, fluffy and can't hold together. Therefore, the difficulty for producing down branch fibers as yarns with current processing (combing, twisting, and drafting) is overcome. The present invention finds a way to use down branch fibers to produce yarns directly without a crimp treatment or a denaturation treatment. Thus, the new devices avoid breaking or damaging down branch fibers during process. Therefore, textile products made by down branch fibers become a reality.

B. Since the present invention adapts reel heat Setting, the shortcomings of down-branch fibers, such as non-crimp, restoring original shape, anti-twisting, low tensile strength, etc. are overcome.

C. Down branch fiber is a kind of nature abnormity fiber. It is light, heating-retaining. The fabrics made by down branch fiber keep these good merits too.

D. The present invention provides bright future to use down branch fibers to fabricate different types of pretty and decent products.

DETAILED DESCRIPTION OF THE DRAWINGS

FIG. 1 is a sketch figure showing the structure of the sliver feeding devise.

DETAILED DESCRIPTION OF THE PREFERRED EMBODIMENTS

FIG. 1 shows a preferred embodiment of the present invention. A sliver feeding devise has a raw material tank 1, a brambly catching roller 4, a brambly dividing roller 7; a feeding belt conveyer 12 is in the bottom of the raw material tank 1; a inclined feeding belt conveyer 2 with fan shape tooth 10 is located at the end of the feeding conveyer belt 12; a adjustable ever roller 3 is located above the middle of the inclined feeding belt conveyer 2; the brambly catching roller 4 is located at the top of the inclined feeding conveyer belt 2; a first subsiding room 5 is located under the brambly catching roller 4; an even roller 6 and a brambly dividing roller 7 are located the end of the first subsiding room 5, the even roller 6 and brambly dividing roller 7 have opposite turning directions; a second subsiding room 8 is located under the brambly dividing roller 7, its discharging port appears bar shape cross section; the discharging port is connected with two dust cages 9 coincidentally; the two dust cages 9 have inhaling chambers that make the two dust cages 9 in negative pressure, the two dust cages 9 have same turning directions; the first and second subsiding rooms 5 and 8, the brambly catching roller 4, the brambly dividing roller 7, and the chamber 11 for the feeding belt conveyer 12, they are connected and communicated together by the case 13.

Embodiment 1

A kind of down branch fiber fabric has a blend ration by weight of 70% down branch fiber and 30% textile fiber.

Process:

Raw material screening→sliver feeding→twisting→winding packages→heat setting→weaving→end product storing Procedure Demonstration:

A. Raw Material Screening:

Get down branch fibers by cutting their quills and shafts off from feathers and downs, where the feathers and downs are collected from waterfowls such as geese, ducks and the like. Textile fibers are adopted from at least one of textile yarn or long silk yarn, which are made from nature fibers including cotton, wool, ramie fiber, or synthetic fibers including terylene, nylon, acrylic, polyvinyl chloride, polypropylene, spandex, vinylon, or chemical viscose fibers.

B. Sliver Feeding Equipment:

This equipment is designed to accommodate for the nature characteristics of the down branch fibers, such as non-crimp, fluffy, non-hold, etc. The down branch fibers or its mixtures are sent out from the raw material tank by the feeding belt conveyer, controlled by the adjustable ever roller continuously, even and in quantity, then fed to brambly catching roller, then combed twice by the brambly catching roller and brambly dividing roller, then evened again by the even roller, then subsided twice by the first and second subsiding rooms; and then fed out through the discharging port finally. A continuous, even strip in certain quantity falls down into a wedge groove consisted by the two dust cages with negative pressure. Finally, even thin strips are produced.

C. Twisting:

Before twisting, according to different raw materials, yarns or long silk yarns as heart yarns are guided into the inner of the thin strips of down branch fiber, and then according to friction spinning technology the two dust cages with negative pressure and same turning direction twists them together to form a kind of down branch fiber yarns, the down branch fibers wrap the heart yarns.

D. Winding Packages:

Use current technology to wind the down branch fiber yarns on cones.

E. Heat Setting

Put down branch fiber yarns on cones into a calorstat-room to heat up, during the heat setting period, heating temperature is generally from 80° to 120° C., and total spending time is from 5 to 20 minutes.

F. Weaving

Through knitting or weaving, make many kinds of fabrics with heat-retaining feature from down branch fiber yards.

G. Put Qualified Products in Storehouses

Inspect products and put qualified products in storehouses

Embodiment 2

A kind of down branch fiber fabric has a blend ration by weigh of 100% down branch fiber and 0% textile fiber.

Process:

Raw material screening→sliver feeding→twisting→winding packages→heat setting→self-twist spinning→weaving→end product storing Procedure Demonstration:

A. Twisting:

Use the two dust cages with negative pressure and same turning direction to twist the thin strips of down branch fibers to form down branch fiber yarns in line with modern friction spinning technology.

B. Self-Twist Spinning

In line with the current textile technology spin the down branch fiber yarns into strands.

C. Weaving

Through knitting or weaving, make strands as different kinds of fabrics with heat-retaining feature.

D. Other Working Procedures are the Same as the Embodiment 1.

Embodiment 3

A kind of down branch fiber fabric has a blend ration by weight of 90% down branch fiber and 10% textile fiber.

Process:

Raw material screening→sliver feeding→twisting→winding packages→heat setting→wrapping→weaving→end product storing Procedure Demonstration:

A. Raw Material Screening:

Textile fibers are adopted from nature fibers or synthetic fibers or long silk yarns.

B. Wrapping:

Use down branch fiber yard as heart yarn, where wrap the heart yarn by nature fibers or synthetic fibers or long silk yarns to form a wrapping heart yarn.

C. Other Working Procedures are the Same as the Embodiment 1.

Embodiment 4

A kind of down branch fiber fabric has a blend ration by weight of 50% down branch fiber and 50% textile fiber by weight.

Process:

Raw material screening→mixing→sliver feeding→twisting→winding packages→heat setting→weaving→end product storing Procedure Demonstration:

A. Raw Material Screening:

Textile fibers are adopted from nature fibers or synthetic fibers.

B. Mixing:

Mix down branch fibers with nature and/or synthetic fibers.

C. Twisting:

Use two dust cages with negative pressure and same turning direction to twist the thin strip of the mixture of down branch fibers nature and/or synthetic fibers to become a strip or a roving in correspondence with the turning rate of the dust cages. Then use rotor spinning and self-actor mules to spin them to become fine counts.

D. Other Working Procedures are the Same as the Embodiment 1.

Embodiment 5

A kind of down branch fiber fabric has a blend ration by weigh of 10% down branch fiber and 90% textile fiber.

Process is the same as the embodiment 4.

Procedure Demonstration:

A. Weaving

Using down branch fiber yarn or down branch fiber mixture yarn as woof, other yarns as warp to weave.

B. Other Working Procedures are the Same as the Embodiment 4.

Embodiment 6

A kind of down branch fiber fabric has a blend ration by weigh of 20% down branch fiber and 80% textile fiber by weight.

Process:

Raw material screening→mixing→sliver feeding→twisting→winding packages→heat setting→self-twist spinning→weaving→end product storing Procedure Demonstration:

A. Self-Twist Spinning

Self-twist spin the down branch fiber yarn or down branch fiber mixture yarn with other fiber yarns to become strand yarn.

B. Other Working Procedures are the Same as the Embodiment 4.

What is claimed is:

1. A device for fabricating down branch fiber fabric comprising a raw material tank for depositing raw materials used for down branch fiber fabric;

a feeding belt conveyer located on the bottom of the raw material tank for feeding the raw materials;

an up-inclined feeding belt conveyer having fan shape tooth located at the end of the feeding belt conveyer for feeding the raw materials up, the up-inclined feeding, fan shape tooth and the speed of the feeding belt conveyer control the fed quantity of the raw material and insure the fed raw materials continuous equably;

an adjustable even roller located above the middle of the up-inclined feeding belt for controlling the fed quantity of the raw material;

a brambly catching roller located at the top end of the up-inclined feeding belt conveyer for catching, combing and feeding the coming raw material into a first subsiding room;

the first subsiding room located under the brambly catching roller for subsiding the raw materials;

an even roller located under the first subsiding room, a brambly dividing roller located under the even roller, the even roller cooperates with the brambly dividing roller to comb the raw material secondly and to feed the raw material into a second subsiding room equably;

the second subsiding room with a discharging port located under the brambly dividing roller for secondly subsiding the raw materials, the discharging port has a bar shape cross section;

two dust cages connected with the discharging port coincidentally, each dust cage has a inhaling chamber with negative pressure, the two dust cages turn to pull the raw material passing through the discharging port and themselves to form a even and continual raw material bar.

2. The device for fabricating down branch fiber fabric of claim 1, wherein the raw material is down branch fiber and/or textile fiber.

3. The device for fabricating down branch fiber fabric of claim 1, wherein the two dust cages have same turning direction, therefore the two dust cages twist the raw material bar becoming raw material yarn.

4. The device for fabricating down branch fiber fabric of claim 3, wherein yarns or long silk yarns as heart yarns are guided into the inner of the twist material, thereby the two dust cages twist the raw material bar becoming a kind yarn that raw material wrap the yarns or long silk yarns inside.

5. The device for fabricating down branch fiber fabric of claim 1, wherein the turn direction of the adjustable even roller at the side of up-inclined feeding belt conveyer is opposite to the moving direction of the up-inclined feeding belt conveyer.

6. The device for fabricating down branch fiber fabric of claim 1, wherein the even roller and the brambly dividing roller have opposite turn direction.

7. The device for fabricating down branch fiber fabric of claim 1, wherein the two dust cages consists of a groove with bar shape.

8. The device for fabricating down branch fiber fabric of claim 1, wherein the raw material tank, feeding belt conveyer, adjustable even roller, brambly catching roller, first subsiding room, even roller, brambly dividing roller, second subsiding room and two dust cages are connected and communicated together in a shell.

* * * * *